US009896996B2

(12) United States Patent
Papke et al.

(10) Patent No.: US 9,896,996 B2
(45) Date of Patent: Feb. 20, 2018

(54) REDUCING TURBOCHARGER ICE DAMAGE

(71) Applicant: International Engine Intellectual Property Company, LLC, Lisle, IL (US)

(72) Inventors: William John Papke, Downers Grove, IL (US); Paul Gottemoller, Princeville, IL (US)

(73) Assignee: International Engine Intellectual Property Company, LLC, Lisle, IL (US)

( * ) Notice: Subject to any disclaimer, the term of this patent is extended or adjusted under 35 U.S.C. 154(b) by 163 days.

(21) Appl. No.: 14/089,399

(22) Filed: Nov. 25, 2013

(65) Prior Publication Data

US 2015/0144112 A1 May 28, 2015

(51) Int. Cl.

| | |
|---|---|
| ***F02B 33/00*** | (2006.01) |
| ***F02B 39/16*** | (2006.01) |
| ***F02M 35/10*** | (2006.01) |
| ***F01M 13/00*** | (2006.01) |

(52) U.S. Cl.

CPC ..... *F02B 39/16* (2013.01); *F01M 13/00* (2013.01); *F02M 35/10222* (2013.01); *F01M 2013/0027* (2013.01)

(58) Field of Classification Search

CPC . Y02T 10/121; Y02T 10/144; F02M 25/0722; F02M 25/0707; F02M 25/0709; F02M 35/10222; F01M 13/00; F01M 2013/0027; F02B 39/16

USPC ..... 123/559.1, 568.27; 60/605.2, 605.1; 29/889.2; 415/208.1

See application file for complete search history.

(56) References Cited

U.S. PATENT DOCUMENTS

2011/0229338 A1* 9/2011 Voong et al. ..... 29/889.2
2013/0266436 A1* 10/2013 Ibaraki et al. ..... 415/208.1

FOREIGN PATENT DOCUMENTS

JP 2008309125 A * 12/2008

OTHER PUBLICATIONS

Translation JP2008309125A.*

* cited by examiner

*Primary Examiner* — Jesse Bogue
(74) *Attorney, Agent, or Firm* — Jack D. Nimz; Jeffrey P. Calfa

(57) ABSTRACT

The present technology provides methods and systems for reducing ice buildup in a closed engine breather system. The systems comprise an air inlet duct, a compressor wheel and a compressor cover. The compressor cover comprises a breather gas port. The breather gas port is placed in the compressor cover at a location within close proximity to the leading edge of the compressor wheel so that the compressor wheel is capable of removing ice that accumulates at the breather gas port. The present technology also provides methods that include providing an air inlet duct, a compressor wheel, and a compressor cover with a breather gas port in the compressor cover. In this manner the compressor wheel can grind or shave off ice that accumulates at the breather gas port.

2 Claims, 4 Drawing Sheets

REDUCING TURBOCHARGER ICE DAMAGE

BACKGROUND

Forced air induction systems are used in vehicles as a way to increase the efficiency of an engine and reduce the emissions of the vehicle. A turbocharger is one example of such a forced air induction system. A turbocharger can include, for example, a turbine and a compressor. In use, exhaust gas that passes through a turbine can provide power and energy for a compressor to compress air and direct the compressed air to the intake manifold of the engine.

In certain situations, it can be useful to employ a closed engine breather systems in a gas or diesel engine. A closed breather system can recirculate gases escaping from the combustion chambers and passing into the crankcase back into the air intake system. These recirculated gases can then be recirculated back to the intake manifold to be burned upon the next pass into the engine. Such closed engine breather systems can help lower the engine emissions because they allow engine blow-by gases to be passed through the engine after-treatment system. Additionally, closed breather systems can reduce the amount of crankcase gasses that are able to enter into the passenger compartment of the vehicle.

A closed breather system traditionally includes a breather tube connected to an air inlet system that is downstream from the air filter and upstream of the engine, compressor, or supercharger air inlet. On a turbocharged engine, for example, this breather tube is often located just before (i.e., upstream of) the turbocharger compressor inlet. However, the recirculated air is often relatively humid and thereby carries with it a significant amount of moisture. This moisture can accumulate along the air intake manifold, or air inlet duct, particularly at the location of the breather port. In cold weather, this accumulation of moisture can freeze, resulting in ice buildup in the closed engine breather system. This ice can break off and fall into a spinning turbocharger compressor wheel, which can cause significant damage. Reducing the accumulation of ice in a closed engine breather system can reduce damage on a turbocharger compressor wheel.

SUMMARY

One or more aspects of the present technology relate to closed engine breather system comprising an air inlet duct, a compressor wheel and a compressor cover. The compressor cover comprises a breather gas port. The breather gas port can be placed in the compressor cover, for example, at a location within close proximity to the leading edge of the compressor wheel. In certain aspects of the present technology, the compressor wheel can be sufficiently close to the compressor cover such that the compressor wheel is capable of removing ice accumulates at the breather gas port.

Certain aspects of the present technology also provide methods for reducing ice buildup in a closed engine breather system. The method can include the steps of providing an air inlet duct, providing a compressor wheel, and providing a compressor cover (also known as a compressor housing). The method also includes providing a breather gas port in the compressor cover. The breather gas port can be placed in the compressor cover within close proximity to the leading edge of the compressor wheel. In this manner the compressor wheel can shave off ice that accumulates at the breather gas port.

DETAILED DESCRIPTION

The present technology presents systems and methods for reducing ice damage to a turbocharger compressor wheel. More specifically, the present technology presents systems and methods that reduce and/or limit the amount of ice that can accumulate in an air inlet duct of a closed engine breather system.

In particular, the present technology provides a closed engine breather system that introduces a breather port in a compressor cover. For example, the breather port can be placed in the compressor cover (i.e., housing) within close proximity (i.e., just past) the leading edge of the compressor wheel. This port can then be connected to the breather pipe, hose, tube, or other conduit for recirculating the air in the closed engine breather system.

One method to reduce or limit the amount of damage that can be caused by ice on a compressor wheel is to provide a compressor wheel made out of titanium. Titanium is a strong material that is capable of sustaining the impact of falling ice without the ice damaging the vanes of the compressor wheel. That is, because titanium is a heavy-duty and strong material, the spinning wheels of a titanium compressor wheel can ingest sizable pieces of falling ice with minimal or no damage. However, titanium is a more expensive material than aluminum. Titanium is heavier than aluminum, which can result in a degraded performance. For example, because an aluminum compressor wheel will have a lower rotational inertia than a titanium compressor wheel of the same geometry, an aluminum compressor wheel will typically result in better transient turbocharger performance. It is therefore useful to provide a system that can reduce, limit, thwart or prevent ice buildup so that a more cost-effective aluminum compressor wheel can be employed.

The present technology addresses the issue of limiting the amount of ice that can accumulate within a closed engine breather system. For example, the present technology places a breather port in the compressor cover rather than in a location of the air inlet duct upstream of the turbocharger compressor wheel. As such, the spinning compressor wheel can grind or shave away any ice that forms at the breather port. In this manner, the ice can be removed as it forms, thereby reducing or limiting the amount of ice that can accumulate within the closed engine breather system. Accordingly, the present technology reduces, limits, thwarts, and in some instances, can even prevent large chunks of ice from falling and hitting the compressor wheel from upstream.

Because ice buildup is shaved away and removed by the turbocharger compressor wheel the vanes on the turbocharger compressor wheel can avoid, or at least reduce the likelihood of sustaining impact and damage from falling ice. As a result, a more cost effective aluminum turbocharger compressor wheel can be employed without exposing the compressor wheel to significant risk of ice damage.

Figure 1:
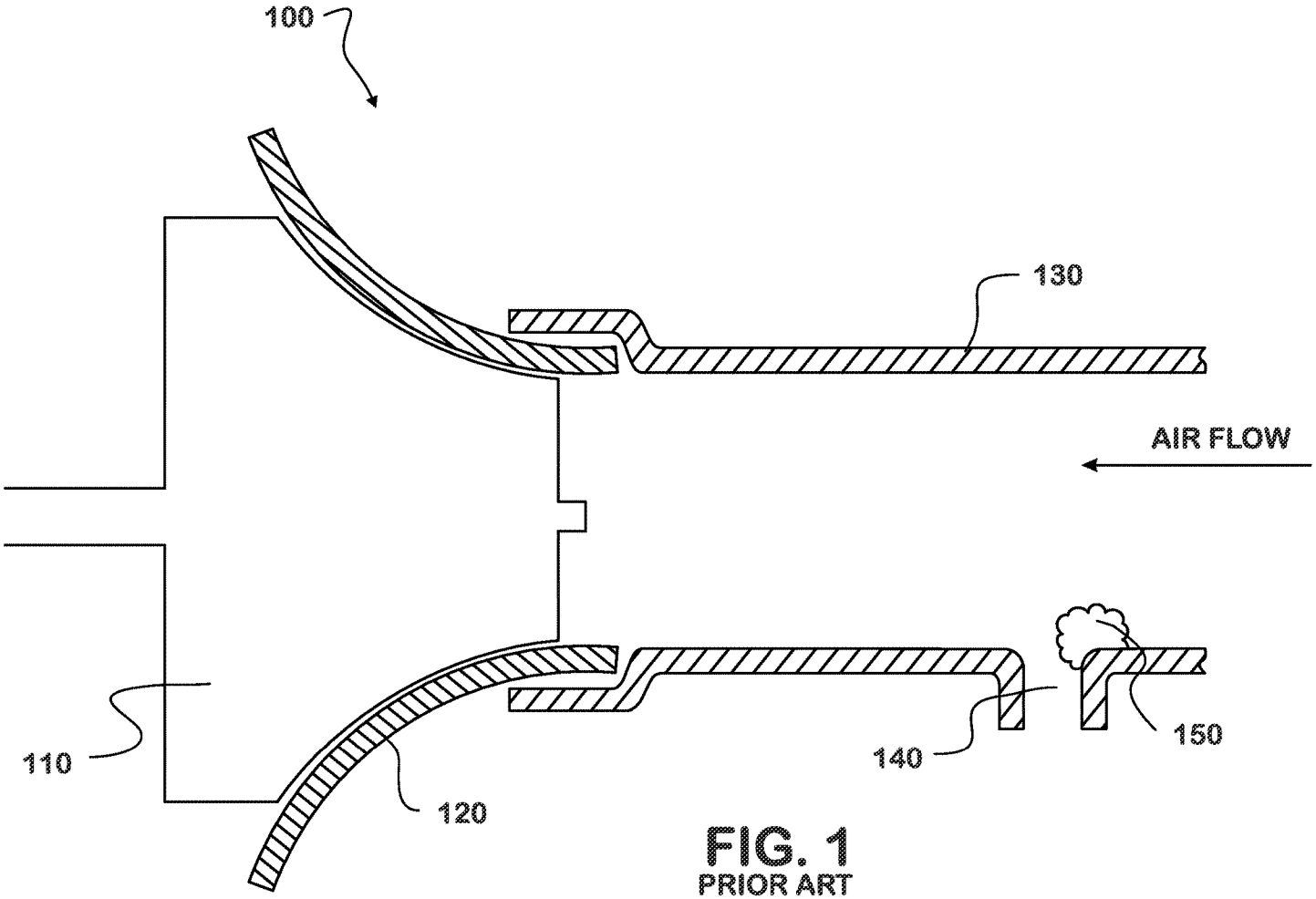
FIG. 1 PRIOR ART
FIG. 1 depicts a closed engine breather system with a breather gas port in the air inlet duct.

FIG. 1 depicts a closed engine breather system 100 with a breather gas port 140 in the air inlet duct 130 of the compressor inlet pipe. In this Figure, the air flow is moving from right to left as shown by the arrow. A compressor wheel 110 is housed inside a compressor housing or compressor cover 120. The breather gas port 140 connects to a breather gas recirculation system, which recirculates combustion air within the engine. Because water vapor is a product of the combustion process, the breather gas entering the air inlet duct 130 can be humid and contain significant amounts of moisture. Moreover, in cold weather conditions, the air flow in the air inlet duct 130 can be exposed to cold, even extremely cold temperatures. Accordingly, in these cold weather situations, the moisture from the breather gas can begin to freeze as it enters the air inlet duct 130 through the breather gas port 140. This, in turn, can lead to an accumulation of a significant amount of ice buildup 150 at or along the breather gas inlet port.

The ice buildup 150 can grow large and can eventually break off from the air inlet duct 130. When this occurs, chunks of ice can fall onto the compressor wheel 110. Because the compressor wheel is spinning at high speeds, the hard ice chunks can cause damage to the vanes of the compressor wheel 110, particularly where the compressor wheel is made of a lightweight or inexpensive material, such as aluminum, for example.

Figure 2:
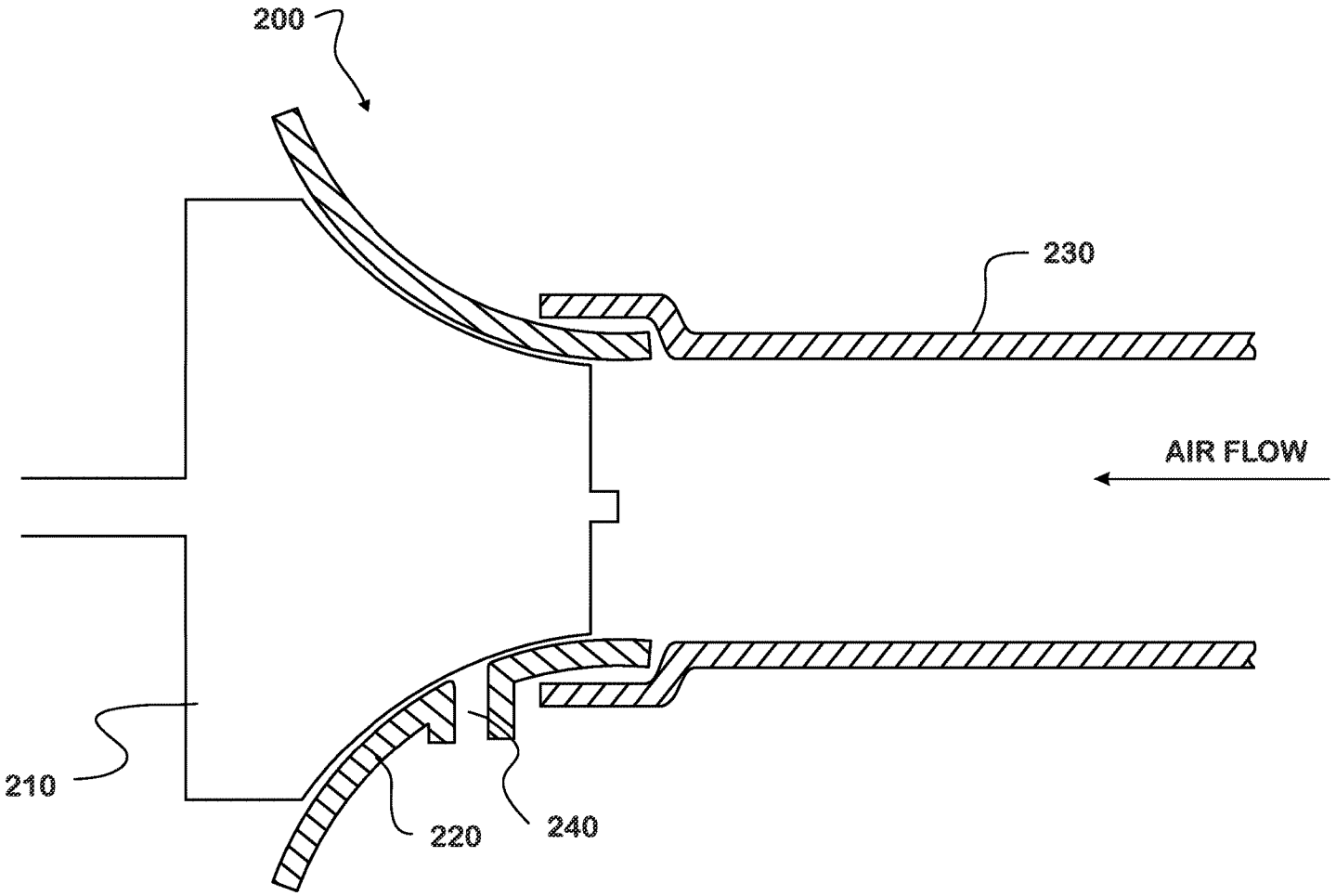
FIG. 2 depicts a closed breather system with a breather gas port in the compressor cover.

The present technology addresses this issue by limiting, reducing, thwarting and/or preventing the amount of ice buildup within the closed engine breather system. FIG. 2 depicts a closed engine breather system 200 employing at least one embodiment of the present technology. As shown in FIG. 2, there is no breather gas port in the air inlet duct 230. Rather, a breather gas port 240 is provided within the compressor housing or compressor cover 220 of the compressor wheel 210. The breather gas port 240 can be in the form of a slit or a groove along the inner surface of the compressor cover 220. For example, the compressor cover 220 may have or comprise one or more slits along the circumference of the compressor cover 220. In between the one or more slits may be one or more ribs (not shown) that connect the upstream portion of the cover 220 with the downstream portion of the cover 220. Additionally and/or alternatively, the breather gas port 240 can be or comprise one or more a holes in the compressor cover 220. Additionally and/or alternatively, the breather gas port 240 can comprise one or more other mechanisms that allows for breather gas to be recirculated into the closed engine breather system 200, such as a grid of holes, a channel, or a pipe or tube port, for example.

In certain embodiments of the present technology, the breather gas port 240 is placed at a location that is just beyond, or within close proximity to the leading edge of the compressor wheel. That is, the compressor wheel can be sufficiently close to the compressor cover such that the compressor wheel is capable of removing ice accumulates at the breather gas port. For example, in certain embodiments the breather gas port can be within a few thousandths of an inch (e.g., 0.003 inches) of the compressor wheel. However, the distance between the breather gas port and the compressor wheel will vary widely depending on the size of the compressor that is used.

In this manner, ice that may build up within the breather gas port 240 can be shaved away by the rotating compressor wheel 210. As such, large clusters of ice will be unable to accumulate in a manner that can cause damage to the compressor wheel 210 or other components of the closed engine breather system 200.

In certain aspects of the present technology the air inlet duct 230 does not comprise a breather gas port. As such, the amount of ice buildup that can accumulate in the air inlet duct 230 will be limited, reduced, thwarted and/or prevented, thereby reducing the likelihood of ice damage that can be caused to the compressor wheel 210 or other components of the closed engine breather system 200 or turbocharger system.

In certain aspects of the present technology, the compressor wheel 210 comprises, and/or is made of aluminum. This allows the turbocharger to be more economical because a cheaper material can make up the compressor wheel. It also provides better turbocharger performance because an aluminum compressor wheel is lighter weight and has lower rotational inertia, which can translate into better fuel economy, lower emissions output, and better turbocharger performance. Additionally, because the amount of ice damage that can occur is reduced, the lighter aluminum material can operate just as effectively as another, more expensive compressor wheel (e.g., a titanium compressor wheel). Additionally and/or alternatively, the compressor wheel can still be made of another material that may or may not be stronger and more durable than aluminum. For example, the compressor wheel can comprise or be made of titanium or another metal. That is, implementing the breather gas port in the compressor cover 220 as proposed by the present technology will allow a turbocharger to be designed without being restricted to a particular compressor wheel material.

The presently described technology provides a system that reduces ice buildup in a closed engine breather system 200. More specifically, the present technology provides a system that reduces damage to the compressor wheel caused by ice buildup. Accordingly, the presently described system can operate within a turbocharger system. Additionally and/or alternatively, the present technology can operate within a closed crank case breather system.

The present technology can be implemented by introducing a compressor cover 220 into the closed engine breather system 200 as described herein. Because the compressor wheel cover 220 of the present technology includes a breather gas port 240, the present technology may involve implementing casting and/or machining techniques that differ from those used to manufacture compressor covers without a breather gas port. However, the present technology can be implemented into existing closed engine breather systems by replacing the existing compressor cover (i.e., a cover without a breather gas port) with a compressor cover that has a breather gas port. Additionally, the breather pipe connection could also be routed to the turbocharger compressor cover instead of the air inlet pipe. Moreover, to the extent that any breather gas ports exist in the air inlet duct, these ports could be closed or sealed off. For example, the presently existing ports could be plugged, deleted or otherwise blocked.

Figure 3:
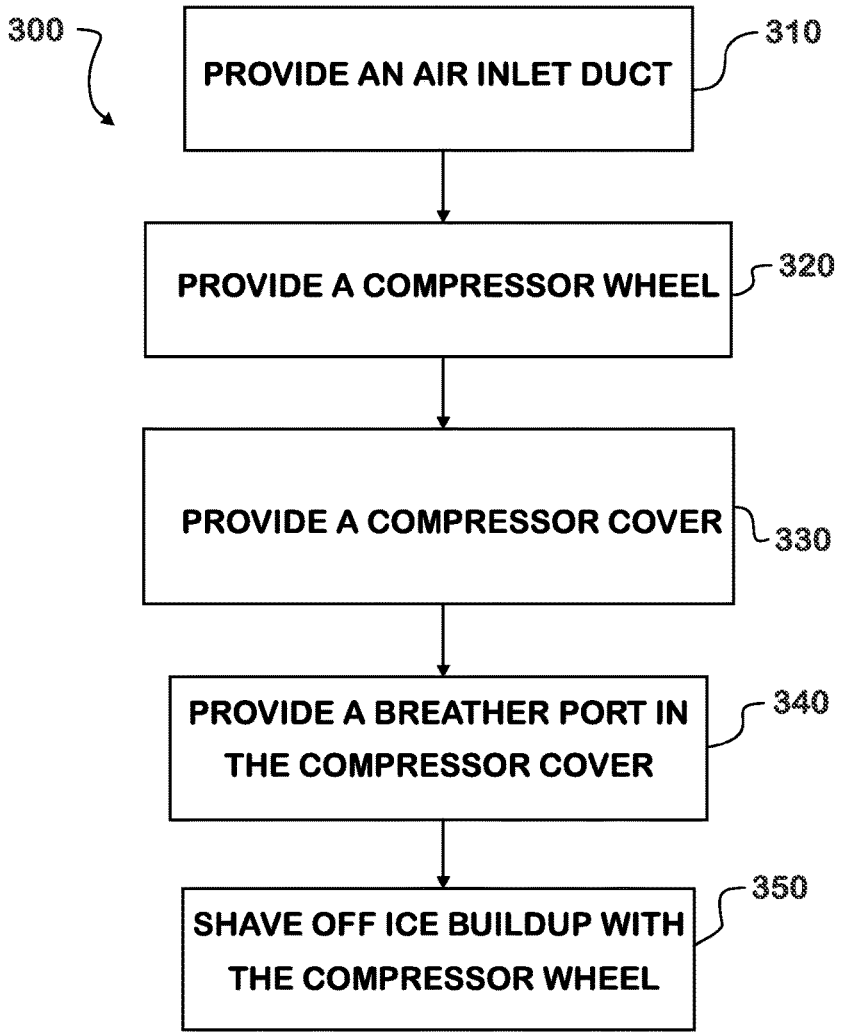
FIG. 3 depicts a flow diagram for a method of reducing ice buildup in a closed engine breather system.
Figure 4:
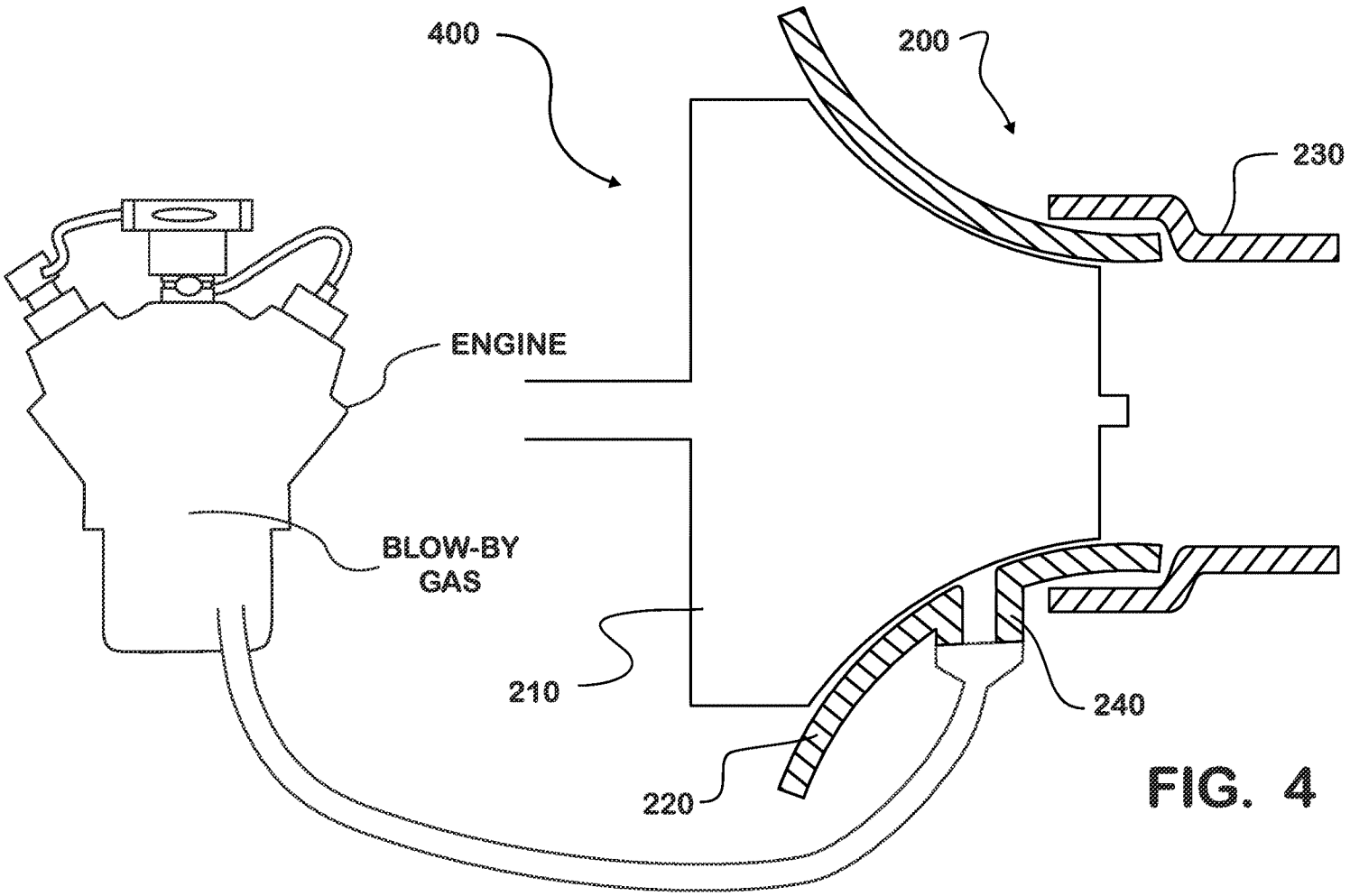
FIG. 4 depicts a closed engine breather system.

The present technology also provides methods for reducing ice buildup in a closed engine breather system. FIG. 3 depicts a flow diagram for a method 300 of reducing ice buildup in a closed engine breather system. As shown in the diagram, step 310 of the method includes providing air inlet duct. In certain embodiments, the air inlet duct will either not have a breather gas port, or will have a pre-existing breather gas port that is plugged, closed, sealed or otherwise blocked.

Next, step 320 provides a compressor wheel. In certain embodiments, the compressor wheel can be made of or comprise aluminum. This allows for a more economical compressor wheel, which can result in better turbocharger performance. Because the present method reduces the amount of ice buildup, the lighter weight aluminum compressor wheel can operate effectively due to the reduced risk of ice damage.

Step 330 provides a compressor cover. The compressor cover is designed to cover the compressor wheel. For example, the compressor cover can be compressor cover 220 as depicted in FIG. 2.

Step 340 provides a breather port in the compressor cover. In this manner the breather port can comprise one or more slits, or one or more holes, for example. The compressor cover can be installed over the compressor wheel as shown in FIG. 2. In particular, the compressor cover can be installed such that the breather gas port is at a location that is just beyond, or within close proximity to the leading edge of the compressor wheel. That is, the compressor cover can be installed such that the breather gas port is close enough to the compressor wheel to be capable of removing ice that accumulates at the breather gas port.

Step 350 includes removing, (e.g., by grinding or shaving off) the ice buildup that accumulates at the breather gas port with the compressor wheel. Because the compressor wheel rotates within close proximity to the breather gas port, the ice that may accumulate at the port will come into contact with the compressor wheel as it builds up and before it is capable of achieving a significant amount of accumulation. The rotation of the compressor wheel is capable of grinding or shaving off the ice as it accumulates. Accordingly, the methods of the present technology can reduce, limit, thwart or prevent ice buildup and ice damage to the compressor wheel or other components of a turbocharger system.

In certain embodiments of the present technology a method can include the steps of providing an air inlet duct, providing a compressor wheel, providing a compressor cover, and providing a breather gas port in the compressor cover as described above. The breather gas port can be placed in the compressor cover within close proximity to the leading edge of the compressor wheel. In this manner the compressor wheel can grind or shave off ice that accumulates at the breather gas port. The method can also employ an air inlet duct that does not comprise a breather gas port. Moreover, the method may also include the step of providing a compressor cover with a breather gas port that includes one or more slits along the inner surface or shroud of the compressor cover. Additionally and/or alternatively, the method may include providing a breather gas port that is a groove, a hole, or another type of crankcase blow-by gas inlet.

The present technology could be employed with any product that uses a turbocharged engine, a turbocharger, a pump, a compressor, or any type of turbomachinery that uses a closed breather system or other type of system that routes a fluid through a port on the turbomachinery. For example, present technology can be employed to a system that recirculates crank case breather gas.

The present technology helps to reduce vehicle emissions on more vehicles because it allows the closed breather system to be able to be applied to turbocharged engines that operate in cold environments. Moreover, because the present technology can be employed to reduce the amount of ice buildup, and therefore reduce the risk potential ice damage, the present technology also provides a way to utilize a cost effective aluminum compressor wheel instead of a more expensive titanium compressor wheel. This allows a turbocharger to employ an aluminum compressor wheel, which has a lighter weight, lower rotational inertia, and, therefore, allows for a better turbocharger performance. This can translate into better fuel economy and lower emissions output for an engine or vehicle.

The invention claimed is:

1. A closed engine breather system for an engine having a crankcase with crankcase gases, comprising:

a compressor wheel having a leading edge; and a compressor housing within which the compressor wheel is disposed;

a breather gas port in the compressor housing, the breather gas port being in downstream fluid communication with the crankcase to receive all of the crankcase gases from the crankcase through the breather gas port;

the breather gas port being disposed in the compressor housing and having an outer circumferential end at a location in overlapping relation with the outer circumferential section of the compressor wheel such that all of the crankcase gases entering the compressor housing pass through the outer circumferential end of the breather port at the location in overlapping relation with the outer circumferential section of the compressor wheel; and the outer circumferential section of the compressor wheel is disposed sufficiently close to the compressor housing such that the ice forming resulting from the crankcase gases being fed into the compressor housing through the breather gas port is continuously removed by the circumferentially outer leading edge of the compressor wheel before it can accumulate.

2. The system of claim 1, wherein the breather gas port is disposed in the compressor cover such that that no ice forms larger than the gap between the circumferentially outer leading edge of the compressor wheel and the compressor housing at the location of the breather gas port.

* * * * *